US006091192A

United States Patent [19]

Winsor

[11] Patent Number: 6,091,192

[45] Date of Patent: Jul. 18, 2000

[54] STRESS-RELIEVED ELECTROLUMINESCENT PANEL

[75] Inventor: Mark D. Winsor, Seattle, Wash.

[73] Assignee: Winsor Corporation, Tumwater, Wash.

[21] Appl. No.: 09/017,255

[22] Filed: Feb. 2, 1998

[51] Int. Cl.[7] ..... H01J 63/04

[52] U.S. Cl. ..... 313/493; 313/483; 313/512

[58] Field of Search ..... 313/493, 512, 313/506, 504, 491, 510, 509, 505, 609, 610, 611, 634, 483, 631

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |

(List continued on next page.)

FOREIGN PATENT DOCUMENTS

| | | | |
|---|---|---|---|
| 0 066 495 A2 | 12/1982 | European Pat. Off. | H01J 61/32 |
| 0 329 226 A1 | 8/1989 | European Pat. Off. | H01J 65/04 |
| 0 550 047 A2 | 7/1993 | European Pat. Off. | H01J 61/70 |
| 89 04 853 U | 8/1989 | Germany | H01J 61/67 |
| 39 22 865 A1 | 1/1991 | Germany | H01J 65/04 |
| 43 13 017 A1 | 12/1994 | Germany | H01J 61/70 |
| 60-216435 | 10/1985 | Japan . | |
| 62-208536 | 9/1987 | Japan . | |
| 1017374 | 1/1989 | Japan . | |
| 64-17374 | 1/1989 | Japan | H01J 61/30 |
| 1206553 | 8/1989 | Japan . | |
| 2-72552 | 3/1990 | Japan | H01J 61/30 |
| 2-78147 | 3/1990 | Japan | H01J 61/30 |
| 3-46748 | 2/1991 | Japan | H01J 61/94 |
| 3-129659 | 6/1991 | Japan | H01J 61/35 |
| 3-222253 | 10/1991 | Japan | H01J 61/92 |
| 3-285249 | 12/1991 | Japan | H01J 61/32 |
| 4-95337 | 3/1992 | Japan | H01J 61/67 |
| 4-147554 | 5/1992 | Japan | H01J 61/30 |
| 06251876 | 9/1994 | Japan . | |
| 947340 | 1/1964 | United Kingdom . | |
| 2 032 681 | 5/1980 | United Kingdom . | |
| 2 217 515 | 10/1989 | United Kingdom | H01J 61/30 |
| WO 87/04562 | 7/1987 | WIPO . | |
| WO 92/02947 | 2/1992 | WIPO | H01J 61/30 |

OTHER PUBLICATIONS

Mercer et al., "Fluorescent backlights for LCDs," *Information Display*: 8–13, Nov. 1989.

Sanyo Electric Co., Ltd., "Flat Fluorescent Lamp Specifications."

Hinotani et al., "Flat Fluorescent Lamp for LCD Back–Light," *1988 International Display Research Conference*.

*Primary Examiner*—Nimeshkumar D. Patel
*Assistant Examiner*—Joseph Williams
*Attorney, Agent, or Firm*—Michael J. Donohue; Seed IP Law Group PLLC

[57] ABSTRACT

An electroluminescent panel is formed on a conductive baseplate by a pair of electrodes that are electrically insulated from the baseplate. The first electrode is a base electrode that acts as the hot electrode. The second electrode is a transparent conductive cover electrode. The cover electrode is grounded to act as a reference electrode. An electroluminescent layer formed from a phosphor-impregnated glass separates the base electrode and cover electrode. Upon application of a voltage between the base electrode and cover electrode, the electroluminescent material emits light that is transmitted through the cover electrode toward a viewer. A passivation layer covers the cover electrode to protect and insulate the cover electrode. In one embodiment, the baseplate is grounded and the cover electrode is referenced to ground through a ground fault interrupt sensor. In another embodiment, a graphical layer overlays the cover electrode, beneath the passivation layer, to present a decorative or informative image. Because the baseplate is not used as an electrode, a substantially thick insulative layer covers the base electrode to insulate the base electrode without affecting the performance of the electroluminescent panel.

20 Claims, 4 Drawing Sheets

U.S. PATENT DOCUMENTS

| | | | |
|---|---|---|---|
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,837,519 | 6/1989 | Lopetrone et al. | 324/529 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,420,481 | 5/1995 | McCanney | 315/291 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,616,989 | 4/1997 | Taillie et al. | 315/32 |
| 5,645,337 | 7/1997 | Gleckman | 362/29 |
| 5,818,164 | 10/1998 | Winsor | 313/493 |
| 5,841,230 | 11/1998 | Ikoma et al. | 313/512 |
| 5,850,122 | 12/1998 | Winsor | 313/493 |
| 5,903,095 | 5/1999 | Yoshida et al. | 313/485 |
| 5,903,096 | 5/1999 | Winsor | 313/493 |
| 5,914,560 | 6/1999 | Winsor | 313/493 |

STRESS-RELIEVED ELECTROLUMINESCENT PANEL

TECHNICAL FIELD

The present invention relates to luminescent display panels, and more particularly, to stress-relieved electroluminescent displays.

BACKGROUND OF THE INVENTION

Electroluminescent panels form low power light-emitting displays for use in many applications. One particular area in which electroluminescent panels can be useful is in lighted signs for advertising and the like.

Electroluminescent panels make use of electroluminescent properties of certain phosphor-impregnated glasses. When an AC voltage is applied across the electroluminescent glass, the electroluminescent glass emits visible light. If an optically transmissive path is available, the emitted light travels outwardly from the electroluminescent glass where it is visible to an observer.

FIG. 1 shows one prior art electroluminescent panel 40 with several layers shown to exaggerated thickness for clarity of presentation. The electroluminescent panel 40 includes a planar metallic baseplate 42 that forms the body of the electroluminescent panel 40 and also acts as a reference electrode. A thin electroluminescent layer 44 carried by a thin bonding layer 46 covers a portion of the baseplate 42. Typically, the bonding layer 46 includes two layers, a ground coat and a white overlayer. The bonding layer 46 typically is on the order of 0.005" thick and the electroluminescent layer 44 is 0.002" thick. The electroluminescent layer 44 typically is a phosphor-impregnated glass such as a zinc sulfide doped with manganese or copper phosphor in a lead-free glass. The electroluminescent layer 44 is deposited by spraying and then firing. The bonding layer 46 is a high adhesive enamel that links the electroluminescent layer 44 to the baseplate 42 to improve the adherence of the electroluminescent layer 44.

A conductive, optically transmissive cover electrode 48 formed from an optically transmissive conductor, such as indium tin oxide (ITO), overlays the electroluminescent layer 44. Together, the baseplate 42 and cover electrode 48 form a pair of electrodes positioned on opposite sides of the electroluminescent layer 44 and bonding layer 46. When an AC voltage is applied across the baseplate 42 and cover electrode 48, an AC electric field is induced in the electroluminescent layer 44. The AC electric field causes the electroluminescent layer 44 to emit light. Some of the light passes directly through the cover electrode 48 toward an observer. Some of the light travels toward the baseplate 42 and strikes the bonding layer 46. The bonding layer 46 reflects light traveling toward the baseplate 42 back toward the cover electrode 48, because the bonding layer 46 is reflective. The reflected light then passes through the cover electrode 48 and is emitted toward an observer.

The enamel of the bonding layer 46 typically is formed from a clay containing trapped gas bubbles which are incorporated in the clay with a specific bubble structure to improve the flexibility and adherence of the bonding layer 46. The gas bubbles can affect the electrical properties of the bonding layer 46, principally by reducing the dielectric constant. The bubble structure for maximum flexibility typically differs from the bubble structure for optimum dielectric construct. Thus, the choice of bubble structure may require a significant tradeoff between durability and electrical performance.

To improve the enamel's adhesion, the enamel typically includes a metal oxide component. Unfortunately, the addition of metal oxide typically deleteriously affects electrical properties of the bonding layer 46 by increasing loss and changing the effective dielectric constant. Consequently, where metal oxides are used, it can be difficult to establish the proper electric field conditions within the electroluminescent layer 44 for proper emission of light.

Also, cracks, holes or thin spots in the electroluminescent layer 44 and bonding layer 46 can cause shorting between the cover electrode 48 and the baseplate 42. Such shorting can impair operation of the panel 40 and can pose safety hazards such as biasing the exposed rear surface of the baseplate 42 to a high voltage or drawing excessive current from a power source. To reduce the risk of cracking, pitting, or thin spots, the typical approach to adhering the enamel of the bonding layer 46 is to first abrade the baseplate 42 before coating with the bonding layer 46. However, such abrasion forms an uneven surface on the baseplate 42, thereby requiring a relatively thick bonding layer 46 to thoroughly cover the baseplate 42. This limits the minimum separation of the baseplate 42 and cover electrode 48, thereby increasing the required AC voltage for a given electric field intensity. Because the level of light emission depends upon the electric field intensity, the relatively large separation of the baseplate 42 and cover electrode 48 requires a high AC voltage. Moreover, the uneven surface of the baseplate 42 makes the thickness of the electroluminescent layer 44 difficult to control. Because the thickness of the electroluminescent layer 44 is difficult to control, the electric field within the electroluminescent layer 44 is difficult to control, making the performance of the electroluminescent panel 40 unpredictable.

To protect the cover electrode 48 and to hermetically seal the electroluminescent layer 44, an optically transmissive, insulative passivation layer 50 covers the cover electrode 48, the electroluminescent layer 44, and part of the baseplate 42. Typically, the passivation layer 50 is a high durability glass coating. The passivation layer 50 conventionally covers only one side of the baseplate 42 to allow easy electrical connection to the baseplate 42.

FIG. 2 shows a typical installation of the prior art panel 40 as an advertising sign where the cover electrode 48 is patterned to a desired shape. In this application, the baseplate 42 is bolted to a support pole 52 by a pair of bolts 54. The pole 52 is driven into the ground such that the pole 52 supports the electroluminescent panel 40. If the pole 52 is conductive, the pole 52 also electrically grounds the baseplate 42. The cover electrode 48 is connected to a cable 56 to allow a driving voltage $V_{in}$ to control the voltage of the cover electrode 48 with respect to ground.

Several difficulties arise with such signs. For example, as can be seen in FIG. 1, the electroluminescent layer 44 and passivation layer 50 cover a single side of the baseplate 42. If the thermal coefficient of expansion of the passivation layer 50 is different from the thermal coefficient of expansion of the baseplate 42, the different expansion rates of the materials can cause the electroluminescent panel 40 to warp in response to temperature changes.

Also, in many applications, such as in an outdoor display, the temperature swings back and forth between high and low extremes. Under such circumstances, the differential expansions of the materials can cause the panel 40 to flex repeatedly, causing premature aging of the layers 44, 46, 48, 50. Repeated temperature cycling can eventually cause cracks in the materials and cause the electroluminescent panel 40 to fail prematurely.

A further drawback of the prior art panel 40 is that the outermost electrode (the cover electrode 48) is the "hot" electrode, i.e., carries a high voltage. Thus, only the passivation layer 50 prevents the high-voltage electrode from exposure. However, any number of sources can cause gaps or cracks in the passivation layer 50. For example, the temperature cycling described above can cause the passivation layer 50 to crack and/or peel. Similarly, objects such as rocks from a nearby road can strike the passivation layer 50, causing holes and exposing the high-voltage electrode 48. Any gaps or cracks in the passivation layer 50 can expose the cover electrode 48, posing a danger of electrical shock.

SUMMARY OF THE INVENTION

A stress-relieved electroluminescent lamp includes an insulative or insulatively coated base having a portion thereof covered by a base electrode. An electroluminescent layer overlays a portion of the base electrode and is covered by a transparent electrode.

In one embodiment, the base is a metal base and the insulative layer is greater than about 0.005" thick. The insulative layer has a bubble structure selected for adequate flexibility and contains a metal oxide to improve adhesion. A base electrode covers the insulative layer and is formed from conventional deposition and photolithographic patterning. A base dielectric formed from a glass selected to have a high adhesion covers the base electrode to act as a transitional layer for additional layers. Next, the electroluminescent layer, deposited by electrophoresis or other conventional techniques, covers the base dielectric to provide a light-emissive material above the base electrode. Together the electroluminescent layer and base dielectric form an insulative region above the base electrode with the thickness of about 0.003".

A transparent cover electrode covers the electroluminescent layer above the base electrode. The cover electrode is covered in turn by a passivation layer of a hermetic ceramic glass that covers the front face of the lamp and wraps around to cover at least a portion of the rear face. Small gaps in the passivation layer allow electrical connection to the base and cover electrodes. Because the base and cover electrodes are insulated from the base, the base can be grounded to provide shock protection and/or to allow a ground fault interrupt configuration. Also, because the passivation layer covers both the front and rear surfaces of the sign, stress on the base due to differential thermal expansion is reduced. The sign is therefore less likely to warp due to temperature swings. Further, because the transparent cover electrode can be used as a reference electrode, the base electrode can be used as the "hot" electrode. Thus, the outermost electrode (i.e., the cover electrode) is not at a high voltage and thus poses less risk of electrical shock.

DETAILED DESCRIPTION OF THE INVENTION

Figure 3:
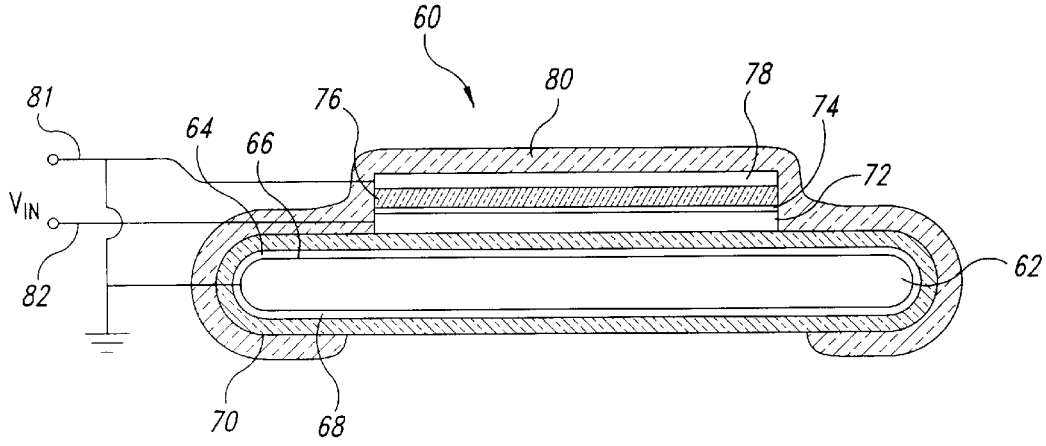
FIG. 3 is a cross-sectional view of a first embodiment of an electroluminescent panel according to the invention showing electrodes isolated from the baseplate.

As shown in FIG. 3, an electroluminescent panel 60 is formed on a conductive, metallic baseplate 62. A high adherence porcelain enamel coating 64 covers both the front and rear faces 66, 68 of the baseplate 62. Unlike the baseplate 42 of the electroluminescent panel 40 of FIG. 1, the baseplate 62 of FIG. 3 is not necessarily used as an electrode. Consequently, the enamel coating 64 is not subject to the same thickness and dielectric constant constraints as the bonding layer 46 and the electroluminescent layer 44 of the panel 40 of FIG. 1. The enamel coating 64 is therefore formed from a relatively thick layer of a porcelain enamel selected to have a thermal coefficient of expansion well matched to the metal baseplate 62. The enamel coating 64 is typically greater than about 0.002" thick and is preferably greater than about 0.003" thick. The enamel coating 64 also has a bubble pattern chosen such that porcelain enamel flexes with the sign without cracking easily. The enamel coating 64 can be chosen from commercially available products with little regard to dielectric constant. Thus, a bubble pattern can be selected for the desired physical properties with few constraints from the electrical properties.

The enamel coating 64 contains a metal oxide, such as cobalt oxide, nickel oxide or a combination thereof, to improve adherence to the baseplate 62. The enamel coating 64 is produced according to conventional porcelain enamel coating techniques. As part of the coating process, the baseplate 62 is first abraded or "pickled" to form a relatively rough surface. As is known, such abrading or pickling significantly improves the adhesion of porcelain enamel to metal surfaces. Then, a solution containing a porcelain enamel is deposited over the pickled surface through electrophoresis and hardened by firing in a furnace.

A porcelain enamel cover layer 70 deposited by electrophoresis or other conventional techniques covers the enamel coating 64 to provide a smooth finish. The cover layer 70 is preferably chosen to have a bubble structure matched to the bubble structure of the enamel coating 64. The cover layer 70 may have a significantly lower metal oxide content than the enamel coating 64. Such a low metal oxide content makes the cover layer highly insulative. Because the cover layer 70 covers the enamel coating 64, and not a metal layer, the cover layer 70 adheres well, even without metal oxide. To reduce stress, the enamel coating 64 and overlayer 70 can be annealed in a conventional oven.

Advantageously, the combination of the enamel coating 64 and cover layer 70 may form a thick insulative coating, typically greater than about 0.005" thick. Such a thick, two-layer coating effectively insulates the baseplate 62 while providing high adhesion and adequate flexibility. The enamel coating 64 and cover layer 70 can be made greater than 0.005" thick, because a thick insulative coating over the baseplate 62 does not detrimentally affect operation of the electroluminescent panel 60, as will be discussed below. Also, because the enamel coating 64 and cover layer 70 can cover both the front and rear faces 66, 68 of the baseplate 62, expansion or contraction of the baseplate 62 relative to the enamel coating 64 and cover layer 70 causes equal stress on opposite sides of the baseplate 62, reducing temperature-induced warping of the electroluminescent panel 60. While the enamel coating 64 and cover layer 70 are described as porcelain enamel, other insulative coatings may be used alternatively. For example, in some applications, a ceramic glass material may be chosen.

A metallic base electrode 72 covers a portion of the cover layer 70. The base electrode 72 is formed atop the cover layer 70 by conventional deposition and photolithographic patterning of a metal layer. Because the cover layer 70 has a smooth finish, the base electrode 72 also presents a relatively smooth surface for additional layers.

Next, a base dielectric 74 is deposited over the cover layer 70 and base electrode 72 by electrophoresis or other conventional techniques. The base dielectric 74 is formed from a glass selected to have a high adhesion and stable dielectric constant and acts as a transitional layer to help additional layers adhere to the base electrode 72. The base dielectric 74 can be made quite thin (typically on the order of 0.001") while still completely covering the base electrode 72, because of the smooth finish of the base electrode 72.

An electroluminescent layer 76 deposited by electrophoresis or other conventional techniques covers the base dielectric 74 to provide a light-emissive material above the base electrode 72. For example, conventional thick film techniques may be used to deposit the electroluminescent layer. Alternatively, the electroluminescent layer 76 may be deposited using conventional thin film techniques with the thickness of the electroluminescent layer being approximately 2,000 Angstroms.

After being deposited, the electroluminescent layer 76 is patterned according to conventional techniques. Preferably, the electroluminescent layer 76 is of a phosphor-impregnated ceramic glass that adheres well to the base dielectric 74. Together, the electroluminescent layer 76 and base dielectric 74 form an insulative region above the base electrode 72, with a thickness of about 0.003" and having a dielectric constant typically greater than 10.

A transparent cover electrode 78, of a material such as indium tin oxide (ITO) covers the electroluminescent layer 76, above the base electrode 72. The cover electrode is formed above the electroluminescent layer 76 by standard deposition and etching procedures. Together, the base electrode 72 and cover electrode 78 form the electrodes of the electroluminescent panel 60, with the electroluminescent layer 76 therebetween. When a voltage $V_{in}$ is applied to the electrodes 72, 78 through a pair of conductive leads 81, 82, the voltage $V_{in}$ induces an electric field in the electroluminescent layer 76. In response to the electric field, the electroluminescent layer 76 emits light. Some of the light travels directly outwardly from the electroluminescent layer 76, through the transparent cover electrode 78 toward the viewer. Some of the light reflects from the metal of the base electrode 72 and travels through the electroluminescent layer 76 and cover electrode 78 toward the viewer.

To protect and insulate the cover electrode 78 and the electroluminescent layer 76, a fired passivation layer 80 of a hermetic ceramic glass covers the front face 66, including the cover electrode 78. Firing the passivation layer 80 hardens the glass nd relieves stress. To more fully seal and protect the baseplate 62, the passivation layer 80 extends to cover a portion of the rear face 68. Small gaps in the passivation layer 80 allow electrical connection to the base and cover electrodes 72, 78. Such gaps an be formed using conventional lift off or etching techniques. While the passivation layer 80 of the preferred embodiment is an optically transparent layer, in some applications, all, or a portion of the passivation layer 80 may be wavelength selective to act as a color filter. By selecting the appropriate filtering properties and selecting appropriate filtering portions of the passivation layer 80, the electroluminescent panel 60 can be made to emit light in selected colors and according to selected patterns, thereby increasing the flexibility of design choices.

Figure 1:
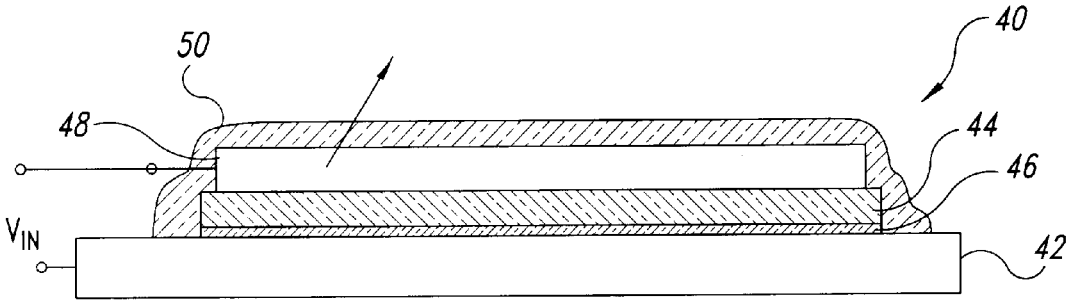
Fig. 1 (Prior Art)
FIG. 1 is a cross-sectional view of a prior art electroluminescent panel having a baseplate as a reference electrode.
Figure 2:
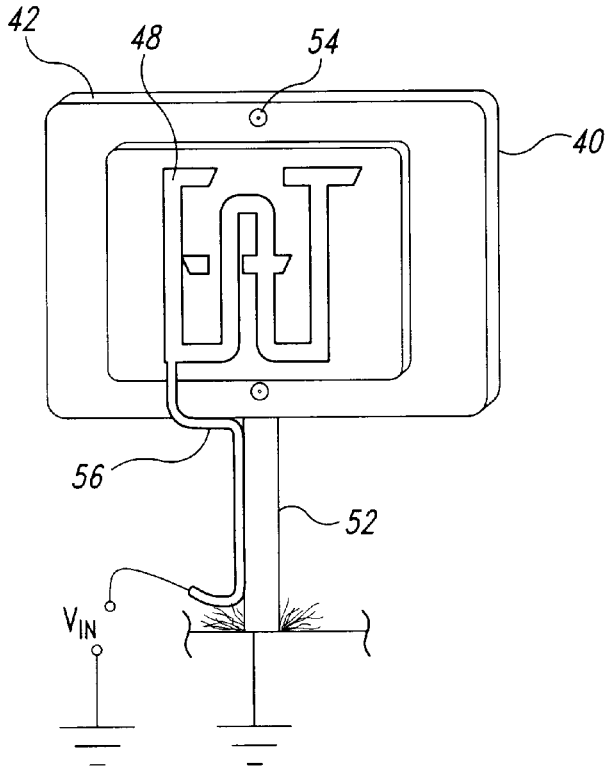
Fig. 2 (Prior Art)
FIG. 2 is an isometric view of a sign incorporating the prior art electroluminescent panel of FIG. 1 showing the baseplate referenced to ground.

One advantage of the present structure can be seen by comparing the electrical connection of the electroluminescent panel 60 of FIG. 3 with the electroluminescent panel 40 of FIGS. 1 and 2. As seen in FIG. 1, the prior art baseplate 42 forms a ground plane and the cover electrode 48 is a "hot" electrode, i.e., carries a voltage well above ground. If the passivation layer 50 fails, or is broken away, the "hot" cover electrode 48 is exposed, presenting a risk of electrical shock or shorting out of the cover electrode 48.

In the electroluminescent panel 60 of FIG. 3, the transparent cover electrode 78 and the baseplate 62 can both be referenced to ground, while the base electrode 72 can be connected as the "hot" electrode. Consequently, the outermost electrode (the cover electrode 78) is a ground electrode. If the passivation layer 80 fails, the exposed cover electrode 78 is grounded, reducing the likelihood of shock or shorting of the electrodes. The "hot" base electrode 72 is covered by the passivation layer 80, the electroluminescent layer 76, and the base dielectric 74, thereby reducing the likelihood of exposure.

While FIG. 3 shows the thicknesses of enamel coating 64 and cover layer 70 on the front and rear faces 66, 68 of the electroluminescent panel 60 as being approximately equal, the thickness of the enamel coating 64 and cover layer 70 need not be identical on the front and rear faces 66, 68. In fact, it is preferred that the thickness of the enamel coating 64 and cover layer 70 on the rear face 68 be chosen to thermally match the response of the combination of the passivation layer 80, the enamel coating 64, and the cover layer 70, on the front face 66. Thus, the enamel coating 64 and cover layer 70 are typically thicker on the rear face 68 than the front face 66. Alternatively, where manufacturing concerns dictate, material properties of the layers can be varied to match expansion properties, rather than varying thickness. For example, the material of the enamel coating 64 on the rear face 68 can be varied to increase the thermal coefficient of expansion and offset the combined effect of the layers 64, 70, 80 on the front face 66. Also, in cases where the electrodes 72, 78 and electroluminescent layer 76 are sufficiently large to affect the thermal response of the electroluminescent panel 60, the thickness of the enamel coating 64 and cover layer 70 on the rear face 68 may be adjusted to compensate.

Figure 4:
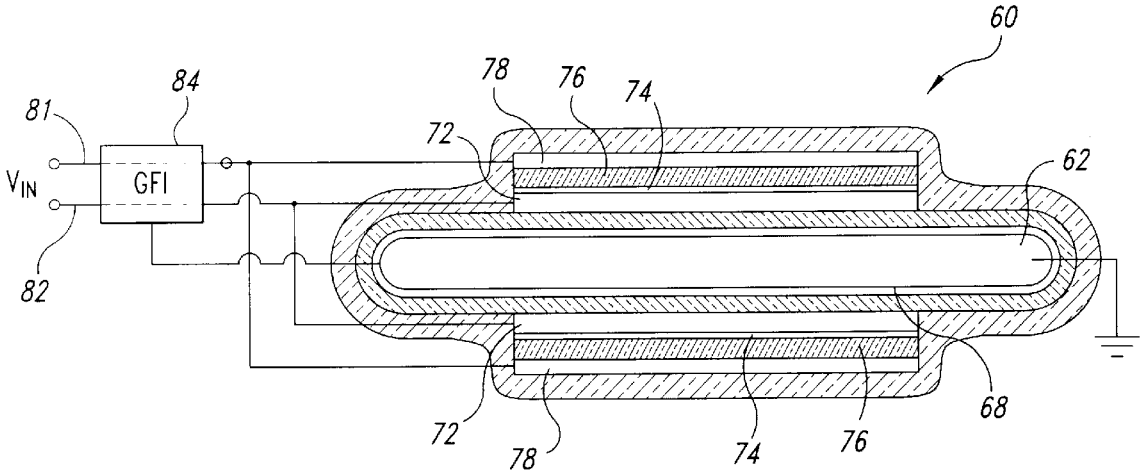
FIG. 4 is a cross-sectional view of a second embodiment of an electroluminescent panel having two display sides and incorporating a ground fault interrupt sensor.

As shown in FIG. 4, the electroluminescent panel 60 can be made two-sided by placing the base electrode 72, base dielectric 74, electroluminescent layer 76 and cover electrode 78 on the rear face 68 of the baseplate 62. Temperature compensation of such a two-sided sign is eased by the symmetricity of the materials on opposite sides of the baseplate 62.

FIG. 4 also shows how the electroluminescent panel 60 can be connected with ground fault interrupt protection. A ground fault interrupt sensor 84 is connected between the leads 81, 82 and referenced to ground through the grounded baseplate 62. As is known, the ground fault interrupt, upon detecting a ground fault problem, decouples the leads 81, 82 to reduce the likelihood of electrical shock. Such connection can also case compliance with local safety ordinances.

Figure 5:
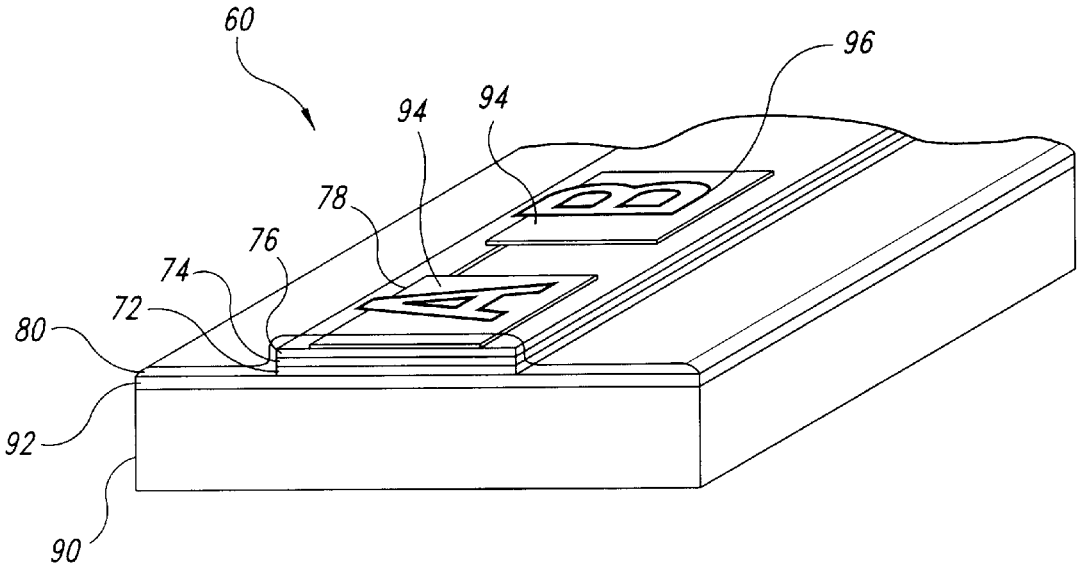
FIG. 5 is an isometric view of a portion of a sign incorporating a plurality of electroluminescent panels according to the invention.

FIG. 5 presents an alternative embodiment of the invention where the electroluminescent panel 60 is formed on a thick base 90 which may be conductive or insulative. A cover layer 92 coats an upper surface of the base 90 to form a smooth surface to carry the remaining layers.

As with the electroluminescent panel 60 of FIG. 3, a base electrode 72, dielectric layer 74, and electroluminescent layer 76 coat the cover layer 92. The transparent cover electrode 78 is patterned to form light-emitting regions 94 on the upper surface of the electroluminescent layer 76.

Unlike the previously described electroluminescent panel 60, the panel 60 of FIG. 5 includes a graphical layer 96 which may be any type of decorative, informative or other design. The graphical layer is an opaque, colored enamel selected for adhesion to the cover electrode 78 and for ease of patterning. Alternatively, the graphical layer may be translucent, colored, or otherwise visible. Additionally, the graphical layer 96 may be of any appropriate graphical material, such as paint, ink or other graphical or decorative material. As with the electroluminescent panel 60 of FIG. 3, a passivation layer 80 overlays the cover electrodes 78 and electroluminescent layer 76 to provide insulation and protection. Because the passivation layer 80 covers the cover electrodes 78, the passivation layer 80 also covers and protects the graphical layer 96.

The electrical properties of the enamel coating 64 and cover layer 70 need not be tightly controlled, because the enamel coating 64 and cover layer 70 are not between the base and cover electrodes 72, 78, and thus do not affect the electric field through the electroluminescent layer 76. Consequently, the enamel coating 64 and cover layer 70 can be made quite thick relative to the separation of the base and cover electrodes 72, 78 such that fabrication of a contiguous, gap-free insulative barrier is simplified. Further, the thicker cover layer 70 can be made quite smooth, because any gaps, pits or other defects can be covered more easily with the thick cover layer 70 and enamel coating 64 as compared to thinner layers.

Additionally, the metal oxide content of the enamel coating 64 can be quite high to improve adhesion, because variations in the dielectric constant of the enamel coating 64 do not significantly affect performance of the electroluminescent panel 60. The enamel coating 64 can thus be made to form a thick, high adhesion layer, as compared to the prior art forming a strong insulative barrier between the base electrode 72 and the baseplate 62.

Figure 6:
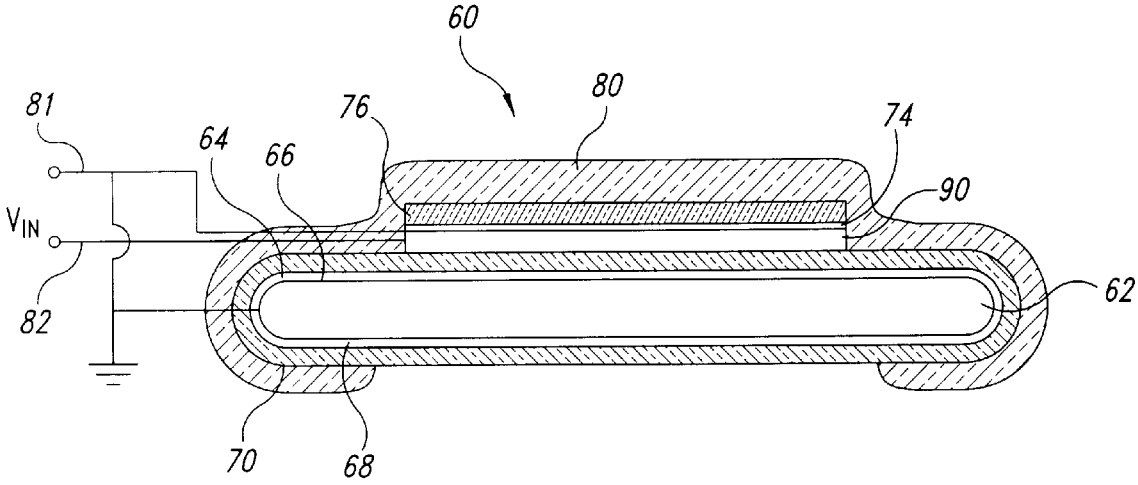
FIG. 6 is a cross-sectional view of another alternative embodiment of an electroluminescent panel showing interdigitated electrodes.
Figure 7:
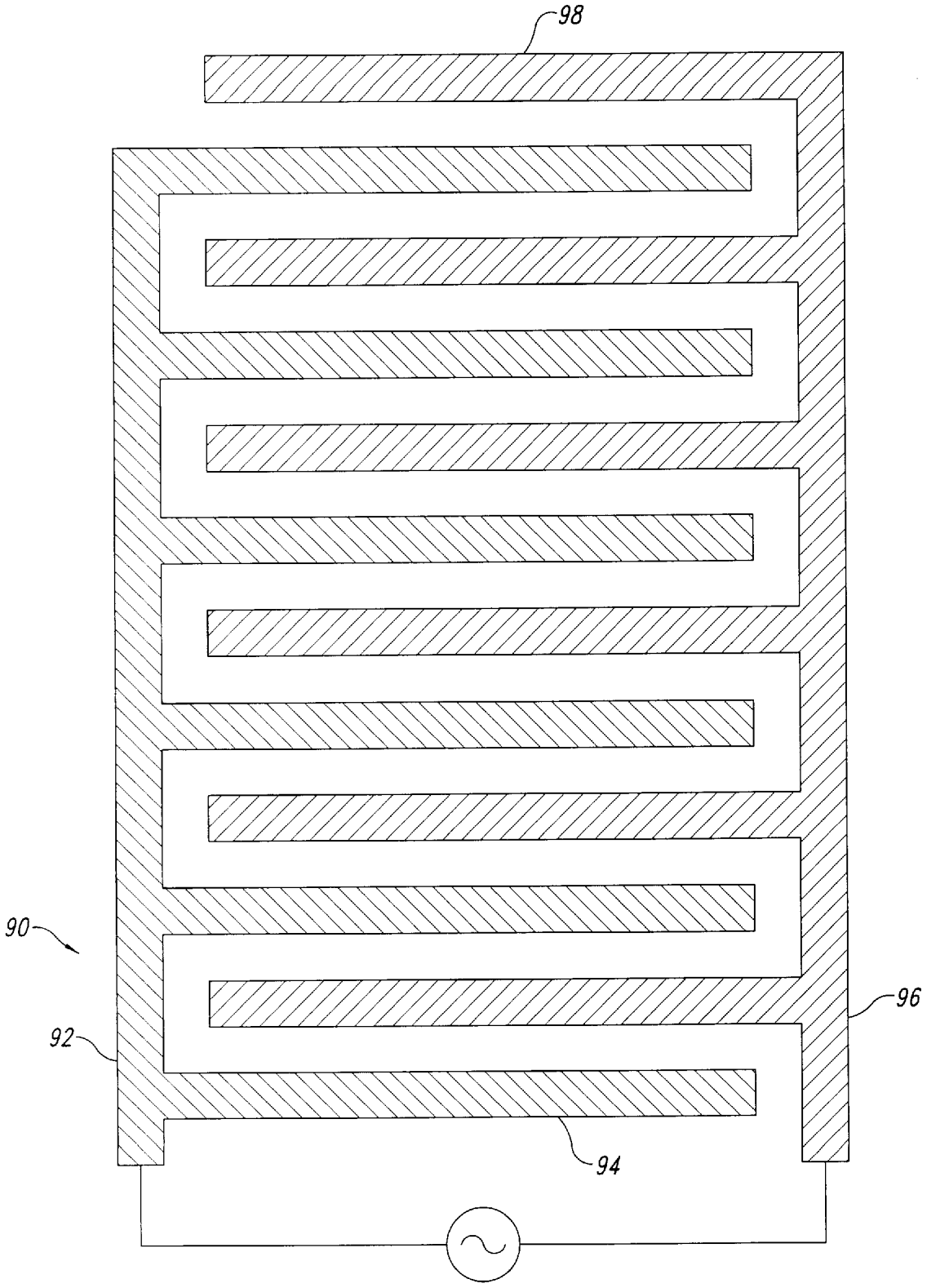
FIG. 7 is a cutaway plan view of the embodiment of FIG. 6 illustrating the interdigitated electrodes.

In the embodiment illustrated in FIGS. 3–5, the base electrode 72 and the cover electrode 78 create an electric field across the electroluminescent layer 76. In an alternative embodiment, the electric field is created in the electroluminescent layer by interdigitated electrodes 90, as illustrated in FIGS. 6 and 7. In this embodiment, the interdigitated electrodes 90 are deposited on the cover layer 70 using conventional techniques. The interdigitated electrodes create the desired electric field in the electroluminescent layer 76 and eliminate the need for the cover electrode 78, thus permitting greater transmission of light from the electroluminescent layer.

As illustrated in FIG. 7, the interdigitated electrodes 90 comprise a first electrode 92 having a plurality of spaced-apart conductive projections 94. A second electrode 96 also comprises a set of spaced-apart conductive projections 98. The conductive projections 94 and 98 alternate with the cover layer 70 to create an interdigitated pattern. When an AC signal is applied to the interdigitated electrodes 90, an electric field is created between each of the conductive projections 94 and 98, thus generating an electric field in the electroluminescent layer 76.

In addition to eliminating the need for the cover electrode 78, which results in an increase in light transmission, the interdigitated electrodes 90 generate the necessary electric field at a lower voltage than may be achieved with the embodiment of FIGS. 3–5. In a preferred embodiment, it is possible to generate the necessary electric field with less than 46 volts rms, which permits the electroluminescent panel 60 to meet international standards for electrical safety. Furthermore, the first and second electrodes 92 and 96 are both created in a single step by depositing conductive material on the cover layer 70. This eliminates the need for a separate step to deposit the transparent cover electrode 78 and simplifies the manufacturing process. The spacing between the projections 94 and 98 may be easily controlled using conventional photomasking techniques. In a preferred embodiment, the spacing between the projections 94 and 98 is approximately 20 to 80 microns.

While the principles of the invention have been primarily illustrated by describing exemplary embodiments of the electroluminescent panel 60, various modifications may be made without deviating from the spirit and scope of the invention. Accordingly, the invention is not limited except as by the appended claims.

What is claimed is:

1. An electroluminescent lamp, comprising:

a substantially planar base having an upper surface and a lower surface;

an insulative coating overlaying the upper and lower surfaces;

a base electrode overlaying a portion of the insulative coating and electrically insulated from the base by the insulative coating;

an electroluminescent layer overlaying a portion of the base electrode; and an optically transmissive cover electrode overlaying a portion of the base electrode with the electroluminescent layer therebetween, the cover electrode being electrically isolated from the base electrode wherein the insulative coating, base electrode, electroluminescent layer and cover electrode are integrally formed.

2. The electroluminescent lamp of claim 1, further including a passivation layer overlaying the cover electrode, the passivation layer being optically transmissive.

3. The electroluminescent lamp of claim 2 wherein the passivation layer extends beyond the cover electrode and overlays substantially the entire upper surface of the lamp.

4. The electroluminescent lamp of claim 3, further including a printed graphical layer overlaying the cover electrode, wherein the passivation layer overlays the printed layer to seal the printed layer.

5. The electroluminescent lamp of claim 3 wherein the passivation layer further extends to edge wrap the base and to overlay a portion of the lower surface of the base.

6. The electroluminescent lamp of claim 5 wherein the passivation layer further extends to overlay substantially the entire lower surface of the base, such that the passivation layer substantially encases the base, base electrode, cover electrode, and the insulative layer.

7. The electroluminescent lamp of claim 2 wherein the electroluminescent layer includes a phosphor impregnated ceramic glass.

8. The electroluminescent lamp of claim 1 wherein the base is metal and the insulative coating is a material selected to have a high adherence to metal.

9. The electroluminescent lamp of claim 8 wherein the insulative coating has a coefficient of thermal expansion matched to a thermal coefficient of expansion of the base.

10. The electroluminescent lamp of claim 8 wherein the insulative coating includes a first layer of an enamel containing metal oxide.

11. The electroluminescent layer of claim 10 wherein the insulative coating includes a second layer of an enamel, substantially free of metal oxide.

12. The electroluminescent lamp of claim 8 wherein the insulative coating has a thickness greater than about five thousandths of an inch.

13. The electroluminescent lamp of claim 6 wherein the insulative coating is an enamel having a bubble structure selected to provide flexibility matching an expected flexing of the base.

14. An illuminated display, comprising:

a conductive display body having an upper surface and a lower surface;

a first insulative layer overlaying the upper surface of the display body;

a base electrode covering a portion of the upper surface and electrically isolated from the display body by the first insulative layer;

a central layer of an electroluminescent material covering a first section of the base electrode;

an optically transmissive cover electrode layer covering a portion of the first section, the cover electrode being patterned to form a user identifiable display pattern; and a second insulative layer overlaying the cover electrode wherein the body, the first and second insulative layers, the base electrode and the central layer form an integral piece.

15. The display of claim 14 wherein the base is grounded, further including:

a terminal connected to the base electrode for supplying driving voltage; and a terminal connected to the cover electrode for providing a reference voltage.

16. The display of claim 15 wherein the cover electrode is electrically connected to the base.

17. The display of claim 15, further including a ground fault interrupt sensor coupled between the cover electrode and the base electrode.

18. An illuminated display, comprising:

a display body having an upper surface and a lower surface;

a first insulative layer overlaying the upper surface of the display body;

a layer of an electroluminescent material overlaying a first section of the display body;

first and second electrodes in proximity with the electroluminescent layer, the first and second electrodes generating a longitudinal electric field within the electroluminescent layer when supplied with electrical power; and a second insulative layer overlaying the first and second electrodes and the electroluminescent layer.

19. The display of claim 18 wherein the first and second electrodes are deposited on at least a portion of the first insulative layer, the first electrode comprising a plurality of conductive projections extending in a first direction along the first insulative layer, the second electrode comprising a plurality of conductive projections extending in a second direction along the first insulative layer and being interdigitated with the conductive projections of the first electrode.

20. The display of claim 18 wherein the first electrode is deposited on at least a portion of the first insulative layer and the second electrode is an optically transmissive cover electrode deposited on at least a portion of the electroluminescent layer.

* * * * *